US008701316B2

(12) United States Patent
Butler et al.

(10) Patent No.: US 8,701,316 B2
(45) Date of Patent: Apr. 22, 2014

(54) AERIAL ADVERTISING DEVICE

(76) Inventors: James Butler, Hollywood, FL (US); James Deveaux Money, San Diego, CA (US)

( * ) Notice: Subject to any disclaimer, the term of this patent is extended or adjusted under 35 U.S.C. 154(b) by 128 days.

(21) Appl. No.: 13/103,125

(22) Filed: May 9, 2011

(65) Prior Publication Data

US 2011/0271567 A1 Nov. 10, 2011

Related U.S. Application Data

(60) Provisional application No. 61/332,852, filed on May 10, 2010.

(51) Int. Cl.
*G09F 21/06* (2006.01)

(52) U.S. Cl.
USPC ..... 40/212; 40/215; 244/1 TD

(58) Field of Classification Search
USPC ..... 40/212–215; 244/1 TD, 3
See application file for complete search history.

(56) References Cited

U.S. PATENT DOCUMENTS 2,238,875 A 8/1939 Manson
2,743,889 A * 5/1956 White ..... 244/76 C
3,501,167 A * 3/1970 Palowsky ..... 280/758
3,861,735 A * 1/1975 Taylor ..... 296/180.1
4,178,706 A 12/1979 Boyce
4,465,251 A * 8/1984 Newbold ..... 244/155 R
5,365,685 A 11/1994 Shank
7,341,351 B2 3/2008 Halmi et al.

* cited by examiner

*Primary Examiner* — Casandra Davis

(74) *Attorney, Agent, or Firm* — Stephen C. Thomas; Robert A. Lynch

(57) ABSTRACT

An aerial advertising device for providing predictable and consistent oscillations to a banner towed behind an aircraft. The aerial advertising device may be disposed at the bottom of the leading edge of a banner. The device may generally comprise a weight box disposed above a wind box. The device may be rotatable about the leading edge or extension, wherein the range of motion of such rotation may be limited by a restriction arm preventing further motion of the device relative to the leading edge. Such rotation may allow the inside walls of the wind box to transfer the applied wind force to the rotation of the device and thereby the rotation of the leading edge of the banner. The weight box may further comprise a horizontal translation arm upon which a slidable weight may slide as the translation arm is moved into greater angular positions relative to horizontal.

8 Claims, 6 Drawing Sheets

AERIAL ADVERTISING DEVICE

CROSS REFERENCE TO RELATED APPLICATIONS

This application claims the benefit of provisional patent application Ser. No. 61/332,852, filed with the USPTO on May 10, 2010, which is herein incorporated by reference in its entirety.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The present invention generally relates to aerial advertising, more specifically, the present invention relates to devices for providing predictable and consistent eye-catching motion to an aerial sign or banner towed behind an aircraft.

2. Background Art

The prior art comprises a wide variety of aerial signs and banners that provide for static fixation of the sign or banner while flown behind an aircraft. One example is disclosed in U.S. Pat. No. 2,238,875 issued to Manson, wherein a streamlined weight may be positioned in different embodiments to provide either a static vertical flight or a static horizontal flight of an aerial sign or banner towed behind an aircraft in flight.

Static aerial signs or banners sufficiently convey the depicted message or advertisement to viewers; however, an aerial sign or banner moving in a predictable and consistent pattern may attract more attention from viewers. Still further, the predictable and consistent motion of the aerial sign or banner may be incorporated into the message or advertisement to add a heretofore unknown dynamic element to the aerial sign or banner. As one example, a human hand depicted on such an inventive aerial sign or banner that consistently pivots about an axis may produce a visual image to viewers where the depicted hand appears to be waving, thereby attracting additional attention and improving the effectiveness of such a unique aerial sign or banner. Prior art devices neither address this need nor provide a means to accomplish such a function. A need exists for such a device to provide predictable and consistent movement to aerial signs and banners to improve and enhance the effectiveness of aerial advertisements.

DETAILED DESCRIPTION OF THE INVENTION

Although the following detailed description contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention.

Figure 1:
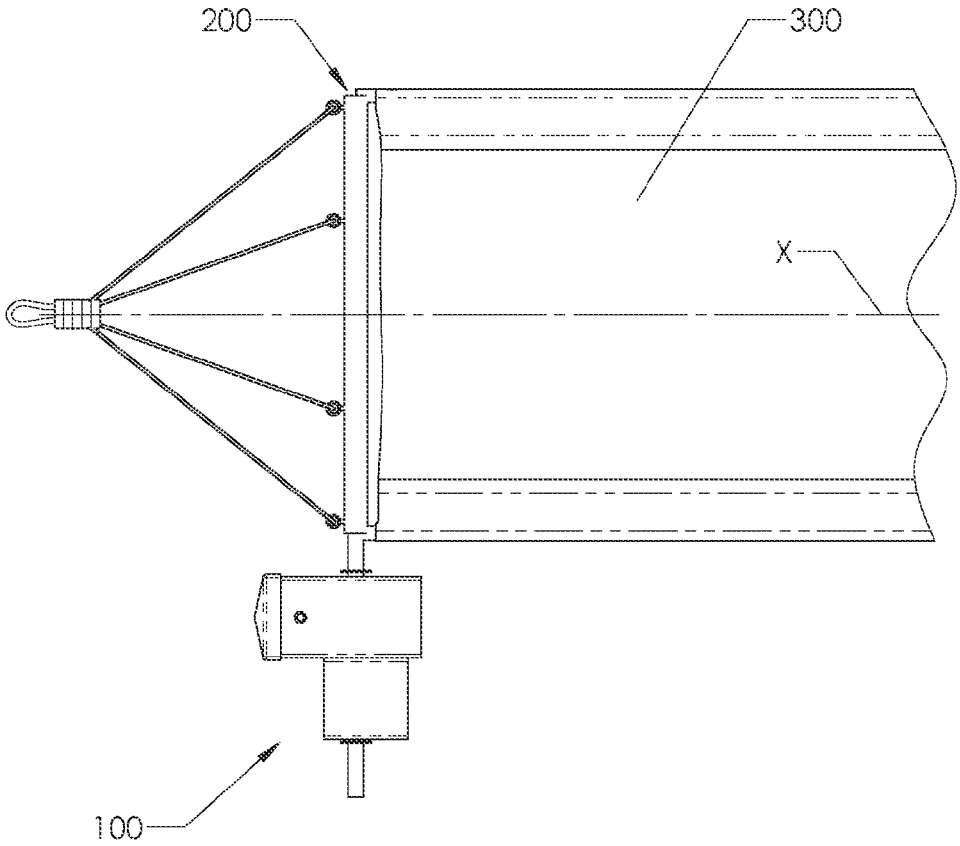
FIG. 1 depicts a left side view of an embodiment of the aerial advertising device of the present invention.

One embodiment of the aerial advertising device 100 of the present invention is illustrated in FIG. 1. In the depicted embodiment, the aerial advertising device 100 is attached to the leading edge 200 of an aerial banner 300. Disposed in such a position, the device 100 may provide a consistent and dependable pivoting motion to both the leading edge 200 and the banner 300 along the longitudinal axis X of the banner 300 as the structure is towed behind an aircraft. Such aircraft may include but are not limited to airplanes, helicopters, airships, gliders, balloons, dirigibles, and the like.

Figure 2:
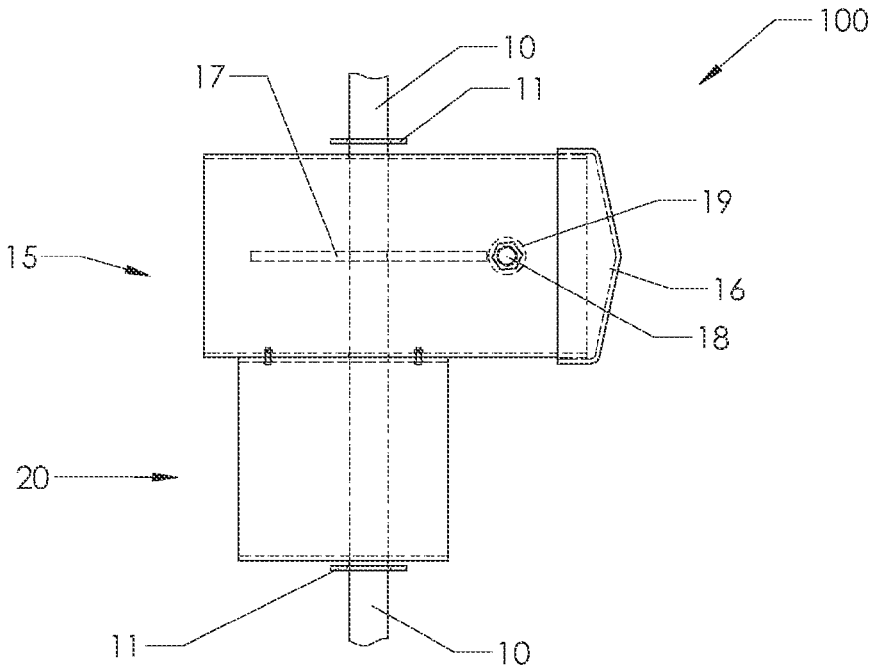
FIG. 2 depicts a magnified right side view of the aerial advertising device of the present invention.
Figure 3:
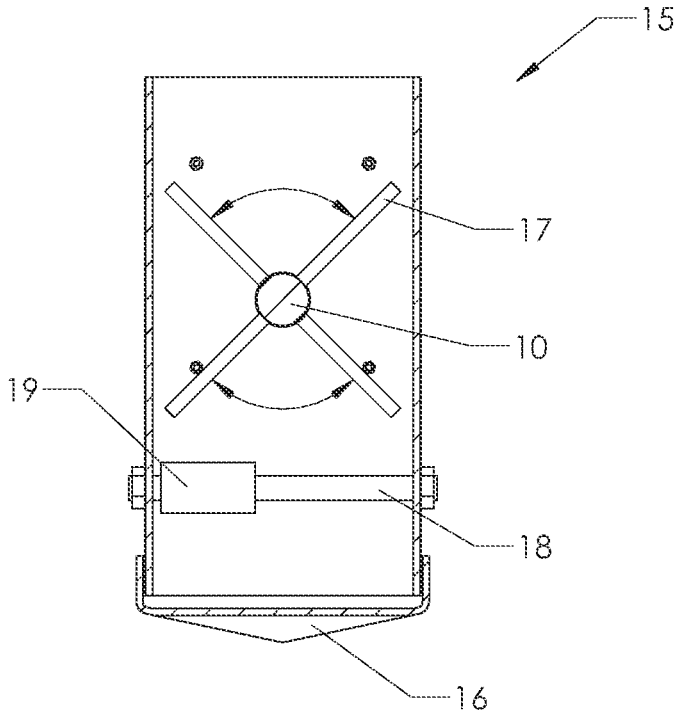
FIG. 3 depicts a top cross sectional view of the aerial advertising device of the present invention.
Figure 4:
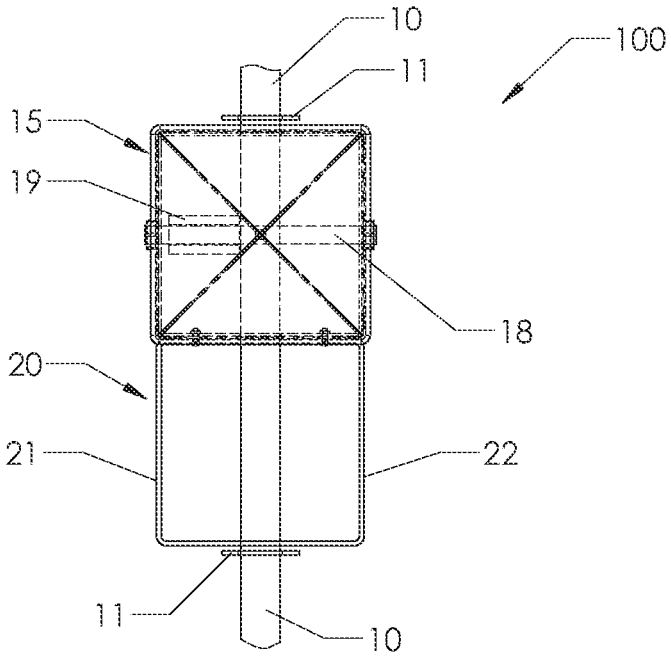
FIG. 4 depicts a front view of the aerial advertising device of the present invention.
Figure 9:
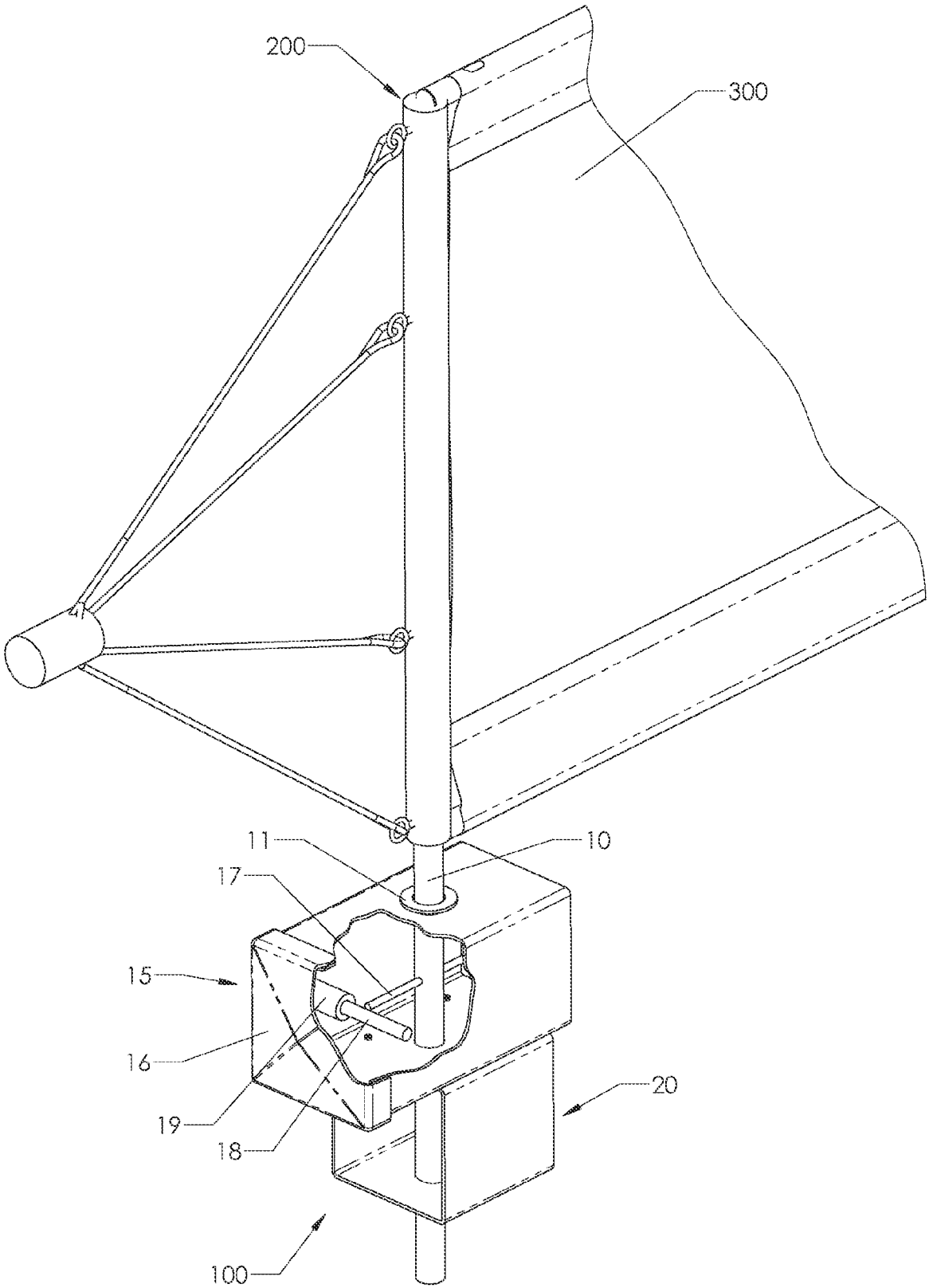
FIG. 9 depicts a perspective view of an aerial advertising device of the present invention.

A preferred embodiment of the aerial advertising device 100 of the present invention is shown in greater detail within FIGS. 2-4 and 9. The leading edge 200 of the banner 300 may either be comprised of unitary construction or have an extension 10 thereon. The device 100 of the present invention may be disposed either at the bottom of the leading edge 200 of the banner 300 or on an extension 10 thereof as shown in FIGS. 2 and 9. One or more flanges 11 may hold the device 100 in vertical position while the device 100 remains rotatable about the extension 10. The device 100 may further comprise a weight box 15 that is secured to a wind box 20 disposed there below as seen in FIGS. 1-2 and 4. In a preferred embodiment, as shown in FIG. 4, the cross sections of both the weight box 15 and the wind box 20 may be square. However, the scope of the present invention is not to be so restricted and may include but is not limited to cross sectional shapes consisting of squares, rectangles, circles, ovals, polygons, and the like. The wind box 20 may comprise any configuration capable of providing one or more surfaces to be acted upon by a wind force. While either a square or rectangular configuration is preferred, the wind box 20 may also comprise embodiments such as a fin or a single wall or single planar surface extending from the weight box 10 and capable of receiving a wind force.

Both the weight box 15 and the wind box 20 are rotatable about the leading edge 200 or an extension 10 thereof. FIGS. 2 4 and 9 show the positioning of the leading edge 200 or extension 10 through both the weight box 15 and the wind box 20 wherein one or more flanges 11 may retain the device 100 in its rotatable position. The wind box 20, as best shown in FIGS. 2 and 4, may comprise a roof, a floor, and side walls that allow wind to pass into the open front end of the wind box 20, continue through the body of the wind box 20, and out the open back end of the wind box 20 as the device 100 is towed behind an aircraft. In a preferred embodiment, the wind box 20 may generally comprise a rectangular cuboid, rectangular prism, and the like. However, as disclosed above, the overall shape of the wind box 20 and the cross sectional shapes thereof are not to be so limited as any shape wind box 20 that is capable of catching the wind to rotate the device 100 about the leading edge 200 or its extension 10 is functionally sufficient within the scope of the present invention. As an illustrative example, an alternate wind box 20 may be ovoid in shape.

As shown in FIGS. 2-4 and 9, the weight box 15 may further comprise a cap 16, a restriction arm 17, a translation arm 18, and a slidable weight 19. The cap 16 may be friction fit or otherwise secured over the leading face of the weight box 20. In this manner, the cap 16 blocks entry of wind into the weight box 15 as the device is towed behind an aircraft. In an alternate embodiment, the cap 16 may be replaced by a front wall of unitary construction with the weight box 15. Cap 16 may assist in the construction of the device 100 and the maintenance of the movable components that are disposed within the weight box 20.

The restriction arm 17 may be attached to or pass through the leading edge 200 or extension 10 thereby providing a fixed object to limit the rotational movement of the device 100 about the leading edge 200 or extension 10. The restriction arm 17 may generally comprise any elongate structure, such as a bolt, that may stop the rotational movement of the device 100 when the inner wall of the rotating weight box 15 contacts the respective ends of the restriction arm 17, as shown in FIG. 3. The restriction arm 17 in FIG. 3 remains stationery relative to the leading edge 200 or the extension 10 whereas the device 100 (e.g. the weight box 15 and the wind box 20) is the structure that rotates and comes into contact with the restriction arm 17 at the ends of its allowed range of movement.

The translation arm 18 may extend between opposing side walls of the weight box 15 having a slidable weight 19 disposed thereon. In a preferred embodiment (see FIGS. 3-4), the translation arm 18 may comprise a cylindrical rod upon which the slidable weight 19, such as a cylindrical weight with an axial hole there through, may move from one side of the translation arm 18 to the other side of the translation arm 18 as the device 100 is tilted relative to the horizontal plane. Neither the size nor shape of either the translation arm 18 or the slidable weight 19 is limiting to the scope of the present invention so long as the slidable weight 19 is free to move across the translation arm 18 when the incline of the translation arm 18 allows the slidable weight 19 to overcome the frictional forces there between. In one exemplary embodiment, the translation arm 18 may comprise a bolt and the slidable weight 19 may comprise a one pound cylindrical weight that is slidable upon the bolt that passes through an axial hole within the cylindrical weight.

In one embodiment of use, the device 100 may be attached to either the leading edge 200 or an extension 10 thereof that is part of an aerial banner 300 being towed behind an aircraft. The cap 16 covering the forward-facing opening of the weight box 15 prevents wind from entering at that location while the forward-facing opening of the wind box 20 is unobstructed and may receive an applied wind force from the movement of air through the wind box 20 as the device 100 is towed behind an aircraft in flight. FIGS. 5A-5D depict front views of a series of positions for the leading edge 200 and the device 100 as the banner 300 pivots relative to the vertical plane Y along the longitudinal axis L of the banner 300. The series of FIGS. 5A-5D shows the movement of the slidable weight 19 within the weight box 15; however, the rotation of the device 100 about the leading edge 200 or extension 10 is left out of FIGS. 5A-5D for the purpose of clarity but such rotation of the device 100 is best depicted in FIGS. 6A-6B.

Figure 5A:
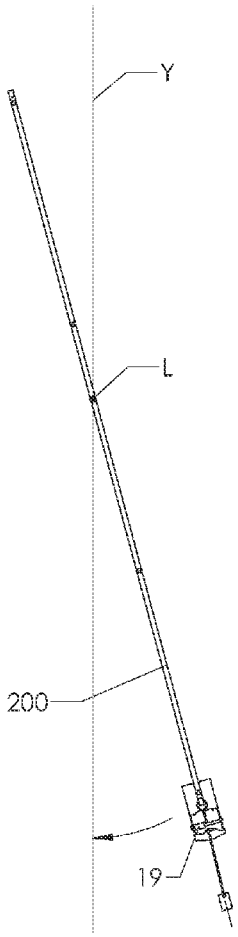
FIG. 5A depicts a generalized front view of the aerial advertising device of the present invention in use.
Figure 5B:
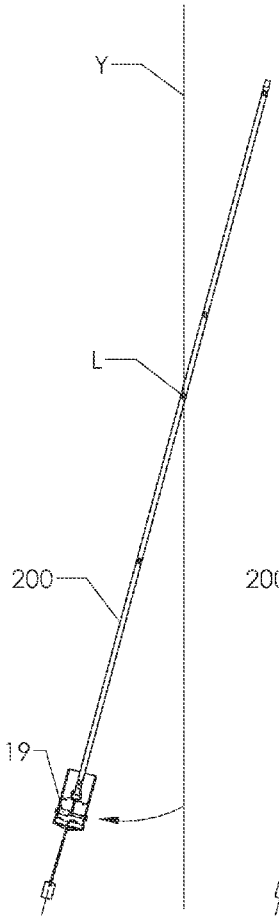
FIG. 5B depicts another generalized front view of the aerial advertising device of the present invention in use.
Figure 6A:
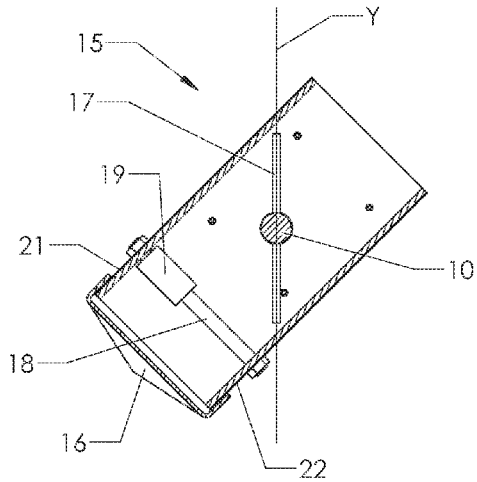
FIG. 6A depicts a top cross sectional view of the aerial advertising device of the present invention in use.
Figure 6B:
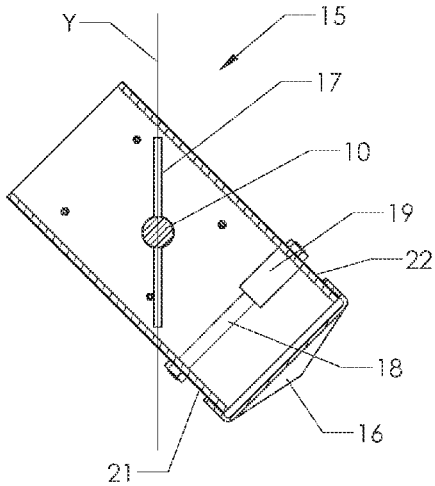
FIG. 6B depicts another top cross sectional view of the aerial advertising device of the present invention in use.

With the slidable weight 19 on the left portion of the translation arm 18 in FIGS. 5A, 5B, and 6A, the slidable weight 19 causes the device 100 as positioned in FIG. 5A to rotate clockwise due to the affect of gravitational forces upon the slidable weight 19 until the inner walls of the weight box 15 come into contact with the restriction arm 17 (as shown in FIG. 6A). As the device 100 rotates clockwise in such a scenario, the inside of the left wall 21 of the wind box 20 receives a wind force to further assist in the clockwise rotation of the device 100 and maintain the device 100 at the end of its range of motion in a clockwise direction (after contact is made between the weight box 15 and the restriction arm 17). The wind force applied on the inside left wall 21 due to the rotated position of the device 100, as shown in FIG. 6A, and the gravitational force upon the slidable weight 19, as shown in FIG. 5A, act in combination to rotate the leading edge 200 of the banner 300 towards and through the vertical plane Y in a "pendulum-like" motion about the longitudinal axis L, as depicted in FIGS. 5A-5B.

Figure 5C:
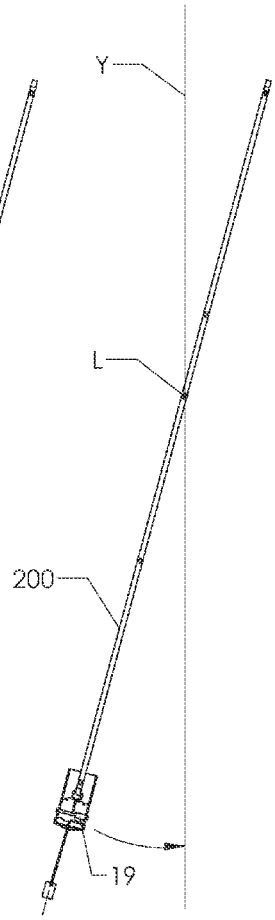
FIG. 5C depicts still another generalized front view of the aerial advertising device of the present invention in use.
Figure 5D:
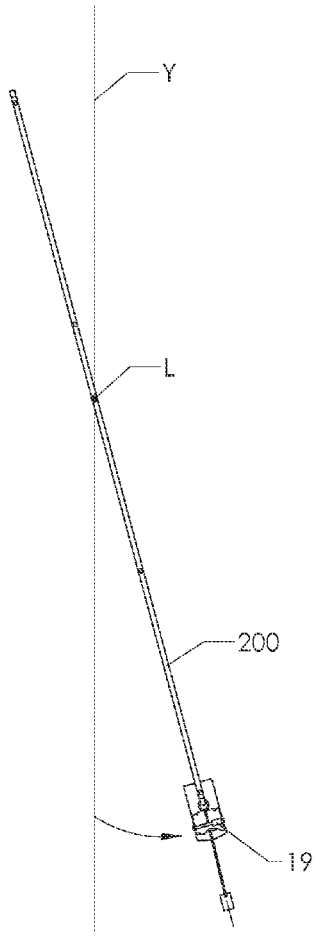
FIG. 5D depicts yet another generalized front view of the aerial advertising device of the present invention in use.

At the position depicted in FIG. 5B, gravity acts to move the slidable weight 19 from the left to the right down the declining slope formed by the position of the translation arm 18 relative to horizontal. As the slidable weight 19 completes its downward slide to the right, as shown in FIG. 5C, the weight shift within the device 100 initiates a counterclockwise rotation of the device 100 about the leading edge 200 or extension 10 until it reaches the end of its counterclockwise range of motion as shown in the top view of FIG. 6B. The force from the mass of the slidable weight 19 moving from left to right (FIGS. 5B-5C) is also enough to overcome the wind force that has a tendency or bias to maintain the device in its fully clockwise rotated position as shown in FIG. 6A. As the shifting force from the slidable weight 19 becomes sufficient to overcome the wind force on the inner left wall 21 of the device 100, the counterclockwise rotation of the device 100 about the leading edge 200 or extension 10 begins and continues until the position of FIG. 6B is reached. Such counterclockwise rotation now creates a wind force that acts on the inside right wall 22 of the wind box 20 that has a tendency to maintain the device 100 in the fully counterclockwise rotated position as the device 100 is towed behind an aircraft. The wind force applied on the inside right wall 22 due to the rotated position of the device 100, as shown in FIG. 6B, and the gravitational force upon the slidable weight 19, as shown in FIG. 5C, act in combination to rotate the leading edge 200 back towards and through the vertical plane Y in a "pendulum-like" motion about the longitudinal axis L, as depicted in FIGS. 5C-5D.

When a banner 300 incorporating the device 100 of the present invention is towed behind an aircraft, the oscillations of the leading edge 200 of the banner 300 become cyclical and consistent in nature and may be effectively utilized in conjunction with dynamic advertising campaigns and/or banners. Due to both the wind force on the wind box 20 and the shifting slidable weight 19, the device 100 is rotated as shown in FIG. 6A for the stages depicted in FIGS. 5A-5B and the device 100 is then rotated as shown in FIG. 6B for the stages depicted in FIGS. 5C-5D. This cycle is continuously repeated as the banner 300 incorporating the present inventive device 100 is towed behind an aircraft.

The scope of the present invention further incorporates the cyclical oscillations of an aerial banner 300 about axes other than the longitudinal axis L (roll) as shown in FIGS. 5A-6B. Such embodiments may include aerial banner 300 rotations about the vertical axis (yaw) and/or the horizontal axis that is orthogonal to the longitudinal axis (pitch).

Figure 7:
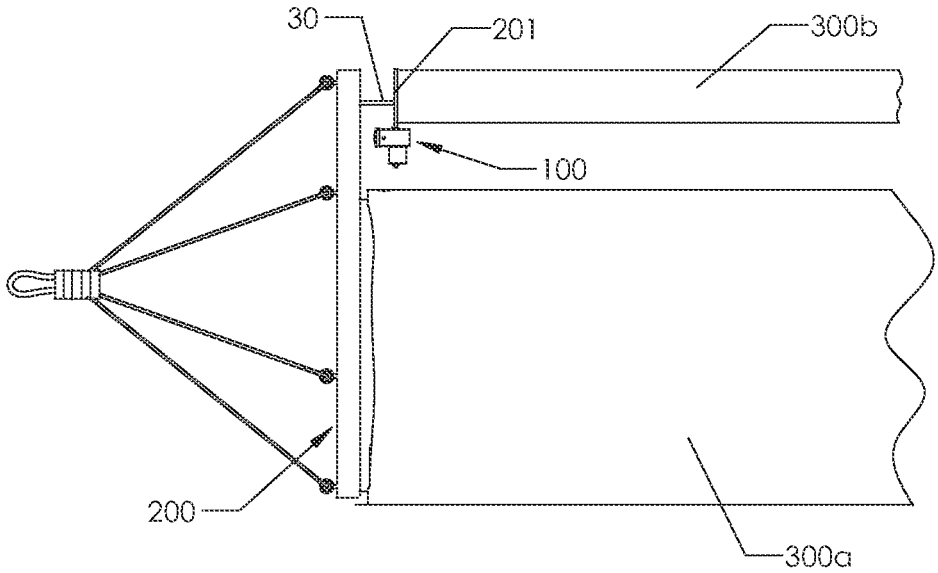
FIG. 7 depicts a side view of another embodiment of an aerial advertising device of the present invention.

Additional alternate embodiment of the present invention may comprise the aerial advertising device 100 being incorporated onto an aerial banner 300 to provide rotation or oscillation capability to at least a portion of the banner 300. FIGS. 7-8C depict two examples of such alternate embodiments.

FIG. 7 depicts an embodiment comprising a conventional leading edge 200 having a stationary banner portion 300*a* attached thereto and a secondary leading edge 201 having a rotatable banner portion 300*b* attached thereto. A connection arm 30 may attach the secondary leading edge 201 to the leading edge 200 via a rotatable connection. The rotatable connection may be disposed at the intersection of the leading edge 200 and the connection arm 30, along the length of the connection arm 30 (e.g. a swivel point) between its end points, and/or at the intersection of the connection arm 30 and the secondary leading edge 201. The inventive mechanical function of the aerial advertising device 100 remains the same as that from the preferred embodiment described above with the exception that in this embodiment the device 100 is attached to the lower end of the secondary leading edge 201. With the embodiment of FIG. 7, the stationary banner portion 300*a* may remain in a generally vertical position when the banner 300 is towed behind an aircraft and the rotatable banner portion 300*b* may rotate or pivot about the connection arm 30 due to the mechanical function and operation of the aerial advertising device 100 as disclosed for the embodiment of FIGS. 1-6B.

Figure 8A:
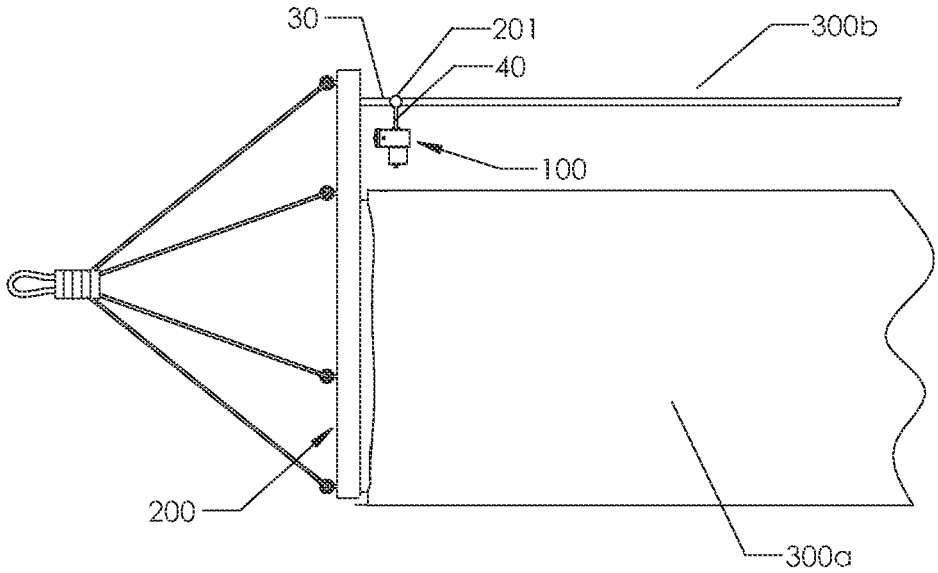
FIG. 8A depicts a side view of the still another embodiment of an aerial advertising device of the present invention.
Figure 8B:
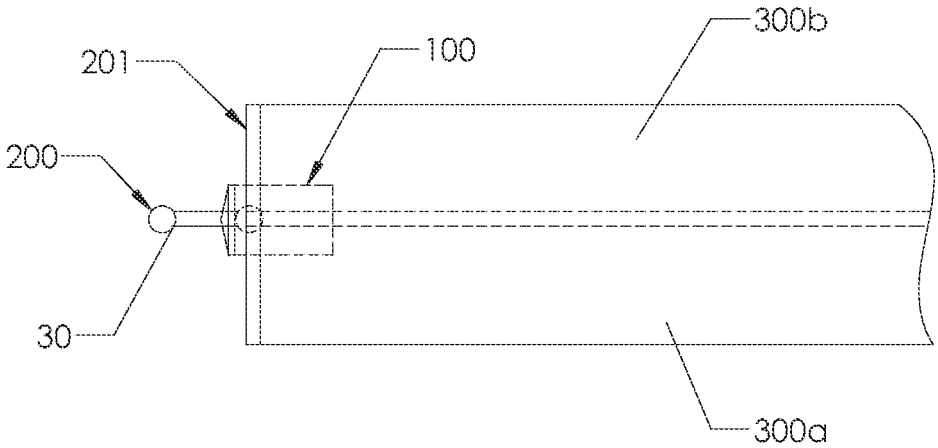
FIG. 8B depicts a top view of the embodiment of an aerial advertising device of the present invention depicted in FIG. 8A.
Figure 8C:
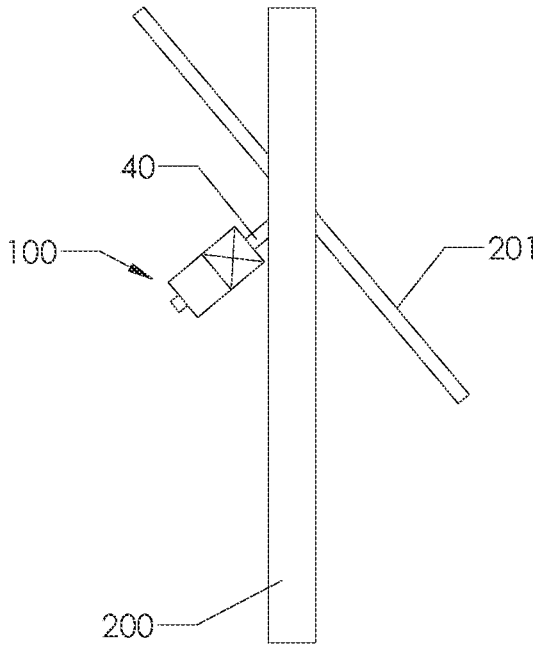
FIG. 8C depicts a front view of the embodiment of an aerial advertising device of the present invention depicted in FIG. 8A in use.

FIGS. 8A-8C depict another alternate embodiment that is highly similar in nature to the embodiment of FIG. 7. Instead of the aerial advertising device 100 being disposed at the lower end of the secondary leading edge 201 as shown in FIG. 7, the device 100 is attached to the secondary leading edge 201 by a T-shaped junction 40 best shown in FIGS. 8A and 8C. In such an embodiment, the rotatable banner portion 300*b* may initially be biased to maintain a generally horizontal position when towed behind an aircraft due to the weight of the device 100 hanging below the plane of the rotatable banner portion 300*b*. As wind force and the slidable weight 19 apply their forces to the secondary leading edge 201 and thereby the rotatable banner portion 300*b*, the rotatable banner portion 300*b* begins to oscillate from an initially thin horizontal profile that is barely visible to a viewer on the ground (see FIG. 8A) to an angled position that becomes increasingly more visible to a viewer on the ground (see FIG. 8C). The rotational effect of the embodiment of FIGS. 8A-8C may give the appearance of a rotatable banner portion 300*b* that is initially invisible or barely discernable but then begins to rotate or oscillate between one of two angled, more viewable positions while the rotatable banner portion 300*b* continuously passes through a horizontal position that is barely discernable to a viewer on the ground.

An alternate embodiment of an aerial advertising device 100 of the present invention may comprise only a weight box 15 without a wind box 20. In such an embodiment, as one example, the dimensions of the opposing side walls of the weight box 15 may be increased to prove an enlarged surface area upon which a wind force may act and thereby replace the functionality provided by the wind box 20 in other embodiments of the present invention.

While the above description contains much specificity, these should not be construed as limitations on the scope of any embodiment, but as exemplifications of the presently preferred embodiments thereof. Many other ramifications and variations are possible within the teachings of the various embodiments.

Thus the scope of the invention should be determined by the appended claims and their legal equivalents, and not by the examples given.

What is claimed is:

1. An aerial advertising device, comprising:

a weight box, wherein said weight box is capable of providing an oscillating weight shift between opposing side walls of said weight box;

a wind box attached to said weight box, wherein said wind box provides one or more surfaces to be acted upon by a wind force; and a leading edge of a banner, wherein said weight box and said wind box are rotatable about said leading edge.

2. The aerial advertising device of claim 1, wherein said weight box and said wind box are held vertically in position by one or more flanges disposed on said leading edge.

3. The aerial advertising device of claim 1, further comprising:

a restriction arm, wherein said restriction arm is fixed to said leading edge and said restriction arm prevents said weight box from being capable of rotating three hundred and sixty degrees around said leading edge when said restriction arm contacts at least one inner wall of said weight box.

4. The aerial advertising device of claim 1, further comprising:

a restriction arm, wherein said restriction arm is fixed to said leading edge and said restriction arm prevents said wind box from being capable of rotating three hundred and sixty degrees around said leading edge when said restriction arm contacts at least one inner wall of said wind box.

5. An aerial advertising device, comprising:

a weight box, wherein said weight box is capable of providing an oscillating weight shift between opposing side walls of said weight box, said weight box comprising:

a translation arm horizontally disposed between said opposing side walls of said weight box, and a slidable weight, wherein said slidable weight is in communication with and slidable in relation to said translation arm;

said aerial advertising device further comprising a leading edge of a banner, wherein said weight box is rotatable about said leading edge.

6. The aerial advertising device of claim 5, wherein said weight box is held vertically in position by one or more flanges disposed on said leading edge.

7. The aerial advertising device of claim 5, further comprising a restriction arm, wherein said restriction arm is fixed to said leading edge and said restriction arm prevents said weight box from being capable of rotating three hundred and sixty degrees around said leading edge when said restriction arm contacts at least one inner wall of said weight box.

8. An aerial advertising device, comprising:

a weight box, wherein said weight box is capable of providing an oscillating weight shift between opposing side walls of said weight box, said weight box further comprising:

a translation arm horizontally disposed between said opposing side walls of said weight box; and a slidable weight, wherein said slidable weight is in communication with and slidable in relation to said translation arm, wherein said slidable weight may further comprise and define a hole through which said translation arm passes;

a wind box attached to said weight box, wherein said wind box provides one or more surfaces to be acted upon by a wind force;

a leading edge of a banner, wherein said weight box and said wind box are rotatable about said leading edge, wherein said weight box and said wind box are held vertically in position by one or more flanges disposed on said leading edge; and a restriction arm, wherein said restriction arm is fixed to said leading edge and said restriction arm prevents said weight box from being capable of rotating three hundred and sixty degrees around said leading edge when said restriction arm contacts at least one inner wall of said weight box.

* * * * *